US008027597B2

(12) United States Patent
Yoda et al.

(10) Patent No.: US 8,027,597 B2
(45) Date of Patent: Sep. 27, 2011

(54) IMAGE FORMING APPARATUS

(75) Inventors: Junya Yoda, Osaka (JP); Akira Shimatani, Osaka (JP)

(73) Assignee: Kyocera Mita Corporation (JP)

( * ) Notice: Subject to any disclaimer, the term of this patent is extended or adjusted under 35 U.S.C. 154(b) by 1006 days.

(21) Appl. No.: 11/977,681

(22) Filed: Oct. 25, 2007

(65) Prior Publication Data

US 2008/0101804 A1 May 1, 2008

(30) Foreign Application Priority Data

Oct. 26, 2006 (JP) ..... 2006-290792

(51) Int. Cl.
*G03G 15/00* (2006.01)

(52) U.S. Cl. ..... 399/21; 399/33; 399/37; 399/67; 399/69; 399/70; 399/88; 399/89

(58) Field of Classification Search ..... 399/21, 399/33, 37, 67, 69, 70, 88, 89
See application file for complete search history.

(56) References Cited

U.S. PATENT DOCUMENTS

| | | | | |
|---|---|---|---|---|
| 5,815,765 | A | 9/1998 | Park | |
| 7,031,630 | B2 * | 4/2006 | Endo | 399/70 |
| 2004/0149740 | A1 | 8/2004 | Kishi et al. | |
| 2004/0245235 | A1 | 12/2004 | Kishi et al. | |
| 2005/0013626 | A1 * | 1/2005 | Satoh et al. | 399/88 |
| 2006/0127118 | A1 | 6/2006 | Kishi et al. | |
| 2007/0098433 | A1 * | 5/2007 | Yano et al. | 399/88 |

FOREIGN PATENT DOCUMENTS

| | | |
|---|---|---|
| CN | 1162530 | 10/1997 |
| CN | 1515130 | 7/2004 |
| CN | 1557112 | 12/2004 |
| JP | 2003-257590 | 9/2003 |
| JP | 2004-200149 | 7/2004 |
| JP | 2006-58731 | 3/2006 |

* cited by examiner

*Primary Examiner* — Ren Yan
*Assistant Examiner* — Andy Pham
(74) *Attorney, Agent, or Firm* — Gerald E. Hespos; Michael J. Porco

(57) ABSTRACT

An image forming apparatus, including: a fixing device having: a first heat generator for generating heat for a fixing processing, the first heat generator using electric power supplied by a commercial power source; and a second heat generator for generating heat for the fixing processing, the second heat generator using electric power supplied by the auxiliary power source device; a heat generation controller for allowing the first heat generator and the second heat generator to generate heat; a sheet jam detector for detecting a sheet jam of a recording sheet which occurs in the image forming section having the fixing device and a conveyance path of a recording sheet; and a charge controller for allowing charging of the auxiliary power source device to start when the sheet jam detector detects a sheet jam, and the charged capacity detector detects no full charge of the auxiliary power source device.

5 Claims, 4 Drawing Sheets

IMAGE FORMING APPARATUS

BACKGROUND OF THE INVENTION

1. Field of the Invention

The present invention relates to an image forming apparatus provided with an auxiliary power source device for storing electric power of a commercial power source and supplying the stored electric power and a fixing device having a heat generator for generating heat with electric power supplied by the commercial power source and a second heat generator for generating heat with electric power supplied by the auxiliary power source device.

2. Description of the Related Art

Conventionally, there have been used image forming apparatuses such as a copying machine, a printer, a facsimile machine, a scanner, and a so-called complex machine. In such image forming apparatuses, there is provided an auxiliary power source device for storing electric power of a commercial power source and supplying the stored electric power. Further, other than a first heat generator for generating heat for a fixing processing by using electric power supplied by the commercial power source, a fixing device is provided with a second heat generator for generating heat for the fixing processing by using electric power supplied by the auxiliary power source device. When the fixing device is started up, fixing rollers and the like can be heated quickly with use of the first and second heat generators.

Here, there is a case where a capacity of electric power of the auxiliary power source device runs short when it is required to start up the fixing device. Therefore, there has been a proposed manner of starting up a fixing device by using only electric power supplied by a commercial source at the time when the capacity of the auxiliary power source device runs short (refer to Japanese Patent Unexamined Publication Nos. 2003-257590, 2004-200149, and 2006-058731). On the other hand, there is a case where a jam (sheet jam) occurs in an image forming apparatus during an image forming operation is performed. When a sheet jam occurs, the image forming operation is stopped, and the occurrence of the sheet jam is displayed on an operation panel to allow a user to open an apparatus cover and treat the sheet jam. Then, the image forming operation is restarted after when the user treats the sheet jam and close the apparatus cover.

When such sheet jam occurs, all operation of the apparatus is stopped, and generation of heat by the two heat generators is stopped since a user might open the apparatus cover and touches inner parts of the apparatus. Consequently, the temperature of fixing rollers and the like of the fixing device lowers. After the sheet jam is treated, it is necessary to start up the fixing device. However, when no electric power is left in the auxiliary power source device, the second heat generator cannot generate heat. Therefore, the fixing device cannot be started up quickly. Further, if the auxiliary power source device is charged again when the image forming is performed after the treatment of the sheet jam, the second heat generator can be used only after the charging is completed. However, the processing delays because of the time necessary for the charging.

SUMMARY OF THE INVENTION

The present invention has been worked out to solve the problems described above, and it enables execution of a processing of generating heat assuredly without delay with use of electric power of an auxiliary power source device in an image forming performed after treatment of a sheet jam.

In particular, the present invention includes an image forming apparatus, comprising: an auxiliary power source device for storing electric power of a commercial power source and supplying the stored electric power; a fixing device including: a first heat generator for generating heat for a fixing processing, the first heat generator using electric power supplied by the commercial power source; and a second heat generator for generating heat for the fixing processing, the second heat generator using electric power supplied by the auxiliary power source device; a heat generation controller for allowing the first heat generator and the second heat generator to generate heat; an image forming section for forming an image on a recording sheet, the image forming section including the fixing device and a sheet conveyance path to allow the recording sheet to pass through the fixing device along the sheet conveyance path; a sheet jam detector for detecting a sheet jam of a recording sheet which occurs in the image forming section; a charged capacity detector for detecting a charged capacity of the auxiliary power source device; and a charge controller for allowing charging of the auxiliary power source device to start when the sheet jam detector detects a sheet jam, and the charged capacity detector detects no full charge of the auxiliary power source device.

These and other objects, features and advantages of the present invention will become more apparent upon reading of the following detailed description along with the accompanied drawings.

DETAILED DESCRIPTION OF THE PREFERRED EMBODIMENTS

Figure 1:
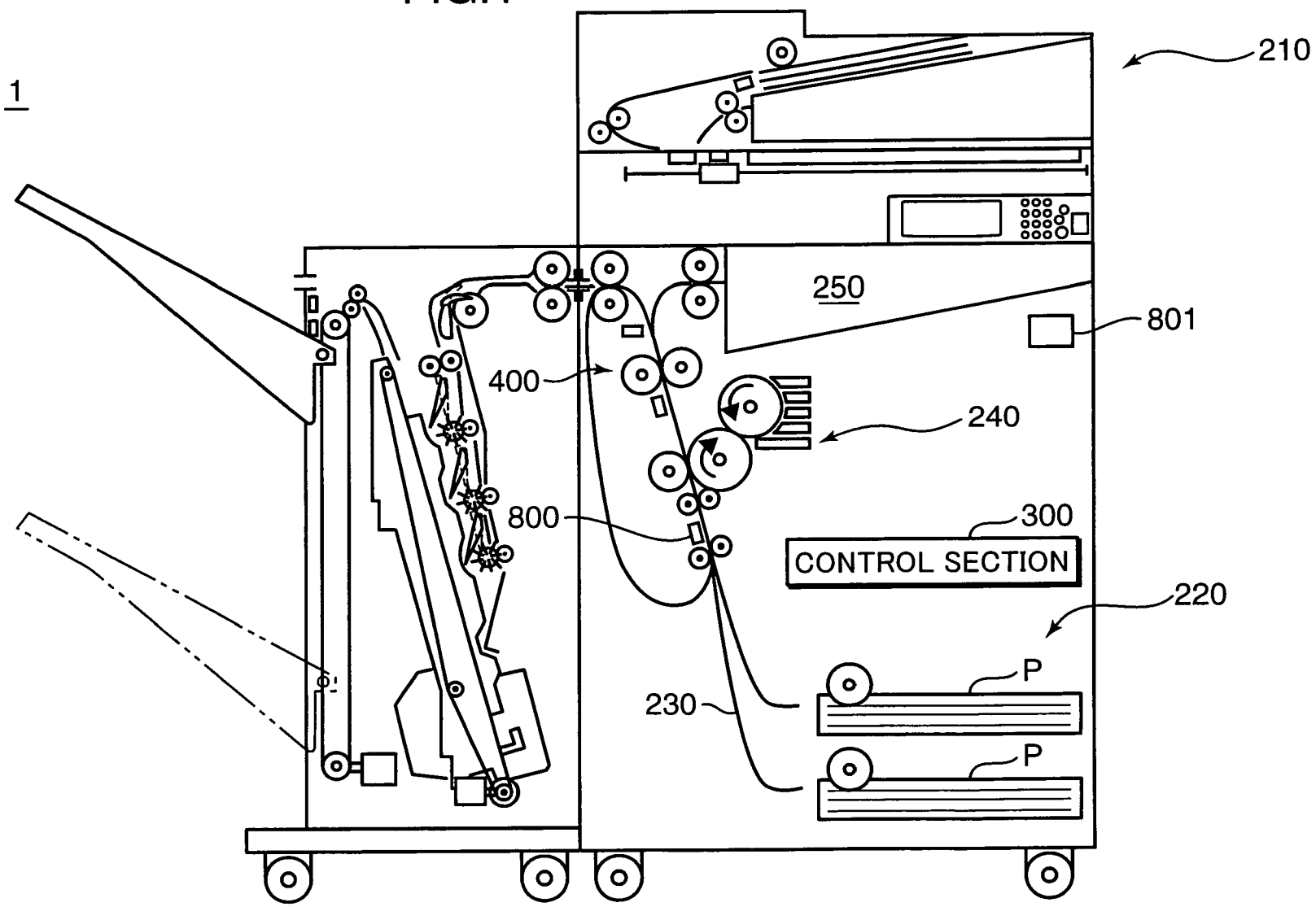
FIG. 1 is an overall view showing a configuration of a copying machine which is an example of an image forming apparatus according to an embodiment of the present invention.

Hereinafter, a copying machine which is an example of an image forming apparatus according to an embodiment of the present invention will be described with reference to the drawings. FIG. 1 is an overall view showing a configuration of the copying machine which is an example of the image forming apparatus according to the embodiment of the present invention.

A copying machine 1 is an example of an "image forming apparatus" referred to in the claims. The copying machine 1 includes an image reading section 210 for reading an image of a document set to be copied, a sheet-feeding section 220 provided with a recording sheet P, a conveying path 230 extending from the sheet-feeding section 220 for conveyance of a recording sheet P, an image forming section 240 provided on the conveying path 230 for forming an image read by the above-described image forming section 210 onto a conveyed recording sheet P, a fixing device 400 also provided on the course of the conveying path 230 and downstream of the image forming section 240 for fixing the image formed on the recording sheet P, a sheet discharging section 250 to which the recording sheet P with the image fixed by the fixing device 400 is discharged, a jam detecting sensor 800 for detecting a sheet jam (so-called jam) in the conveying path 230, a door close detecting sensor 801, and a control section 300 for controlling respective operations of these components.

In the copying machine 1, a sheet jam of a conveyed recording sheet P may occur on the conveying path 230 when a processing of recording an image onto a recording sheet which is conveyed on the conveying path 230 (hereinafter, referred to as a printing processing) is performed.

The jam detecting sensor 800 is a sensor for detecting the sheet jam. It should be understood that a position and the number of the jam detecting sensor 800 depicted in FIG. 1 are mere examples.

The copying machine 1 stops a sheet conveying operation of the conveying path 230, a toner image forming operation of the image forming section 240 to a recording sheet, and a sheet-feeding operation of the sheet-feeding section 220 when a sheet jam occurs, so that a user can open a front cover (not illustrated) of the copying machine 1 and operate inner parts, such as the conveying path 230 and the like, of the copying machine 1 to treat the sheet jam. This front cover is an example of a "cover" referred to in the claims.

The front cover (which is described above) of the copying machine 1 is a front cover which is provided openably on an apparatus housing and in front (front side in the drawing) of the components of the copying machine 1 such as a sheet-feeding section 220, a conveying path 230, an image forming section 240, and a fixing device 400 which are depicted in FIG. 1. When this front cover is opened, a user can treat a sheet jam by removing a recording sheet which stops on the course of the conveying path 230 to cause the sheet jam from the conveying path 230, so that the copying machine 1 can restart the image forming operation. When this front cover is closed, it protects the conveying path 230, the image forming section 240 and the like so as to prevent the user from mistakingly touching the sheet-feeding section 220, the conveying path 230, the image forming section 240, the fixing device 400 and the like.

The door close detecting sensor 801 includes a sensor which detects closing of the front cover when a user closes the front cover of the copying machine 1.

The jam detecting sensor 800 is an example of a "sheet jam detector" referred to in the claims. Further, the sheet-feeding section 220, the conveying path 230, image forming section 240, the fixing device 400, and the sheet discharging section 250 constitutes an example of an "image forming section" referred to in the claims. Furthermore, the door close detecting sensor 801 is an example of a "cover operation detector" referred to in the claims.

Figure 2:
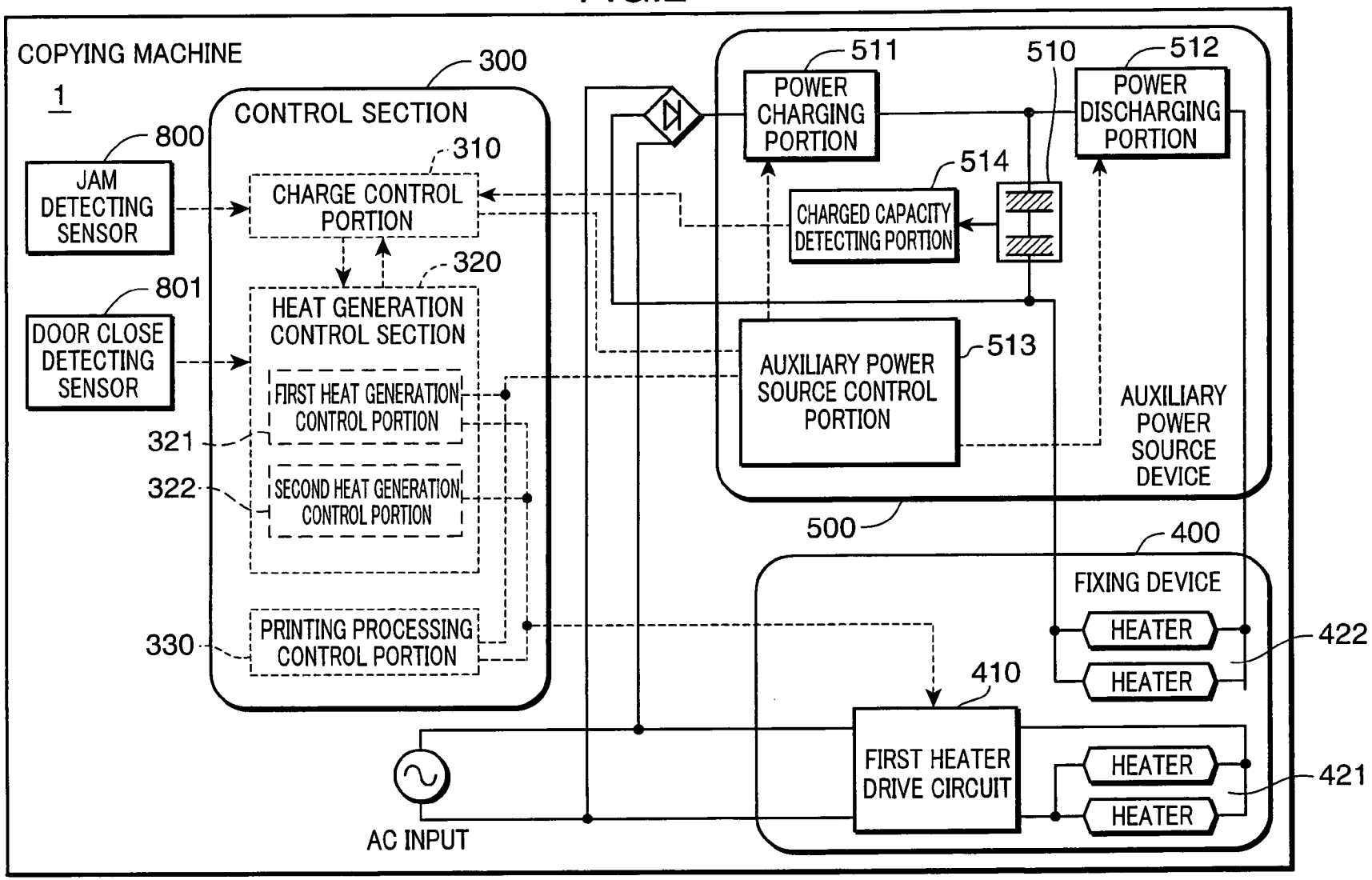
FIG. 2 is a block diagram showing a detailed configuration of the copying machine.

FIG. 2 is a block diagram showing a detailed configuration of the copying machine 1. The control section 300, the fixing device 400, the jam detecting sensor 800, and the door close detecting sensor 801 shown in the configuration of FIG. 2 are also shown in FIG. 1. In FIG. 2, power transmission lines provided between components of the copying machine 1 are illustrated in solid lines, and transmission lines for transmission of information such as control signals between the components are illustrated in broken lines, so that both are distinguished.

The auxiliary power source device 500 includes a power source device which is supplied with electric power by an AC input (commercial power source), stores the supplied electric power, and supplies the stored electric power to the fixing device 400. The AC input has a rated electric power (for example, 1500 W). The total amount of electric power supplied to the fixing device 400 and other parts of the copying machine 1 cannot be greater than the rated electric power. However, if electric power supplied from the AC input is stored in advance in the auxiliary power source device 500, it becomes possible to allow the copying machine 1 to perform operations with use of electric power which is greater by electric power supplied by the auxiliary power source device 500 than the rated electric power of the AC input.

The auxiliary power source device 500 includes a capacitor device 510, a power charging portion 511, a power discharging portion 512, an auxiliary power source control portion 513, and a charged capacity detecting portion 514. The auxiliary power source device 500 is an example of an "auxiliary power source device" referred to in the claims.

The capacitor device 510 includes a power storage device having large capacitors arranged in series.

The charged capacity detecting portion 514 detects a charged capacity of the capacitor device 510. The charged capacity detecting portion 514 may include a voltage measuring circuit connected to the capacitor device 510. The charged capacity detecting portion 514 is an example of a "charged capacity detector" referred to in the claims.

The power charging portion 511 is supplied with electricity by the AC input, and charges the above-described capacitor device 510 with the supplied electric power. The power charging portion 511 is supplied with electricity by the AC input through a rectifier (for example, a diode bridge), and supplies DC electric power rectified by the rectifier to the capacitor device 510 to charge the capacitor device 510.

The power discharging portion 512 allows the capacitor device 510 to discharge electric power to supply electric power stored in the capacitor device 510 to a second heater 422 of the fixing device 400.

The auxiliary power source control portion 513 is adapted to control the power charging portion 511 and the power discharging portion 512. The auxiliary power source control portion 513 receives input of control signals from the control section 300 and controls the power charging portion 511 and the power discharging portion 512 according to the received control signals. It should be understood that the auxiliary power source control portion 513 is not essential. The control section 300 may input control signals directly to the power charging portion 511 for controlling operation of the power charging portion 511, or the control section 300 may input control signals directly to the power discharging portion 512 for controlling power discharging portion 512.

The fixing device 400 heats toner particles on a recording sheet P conveyed on the conveying path 230 to fix the toner image onto the recording sheet P (fixing processing). The fixing device 400 is an example of a "fixing device" referred to in the claims.

As shown in FIG. 2, the fixing device 400 includes a first heater 421 (first heat generator), a second heater 422 (second heat generator), and a first heater drive circuit 410. The first heater 421 is an example of a "first heat generator" referred to in the claims, and the second heater 412 is an example of a "second heat generator" referred to in the claims.

The first heater 421 generates heat for heating the fixing roller and the like with use of electric power (alternate current: AC) supplied by the AC input (commercial power source).

On the other hand, the second heater 422 generates heat with use of electric power (direct current: DC) supplied by the auxiliary power source device 500. Since the second heater 422 generates heat with use of electric power supplied by the auxiliary power source device 500, it can generate heat concurrently with the first heater 421 driven by the AC input.

The first heater drive circuit 410 is supplied with electric power from the AC input, creates electric power to be supplied to the first heater 421, and supplies the created electric power to the first heater 421. Here, these two heaters 421, 422 are, for example, halogen heaters.

The control section 300 includes an information processing device having a CPU, ROM, RAM and the like. The control section 300 executes a software stored in the ROM to obtain a function to control operations of parts of the copying machine 1.

The control section 300 does not need to be realized as a computer having a CPU and the like, but it may be realized as a sequencer, a sequential circuit or the like.

The control section 300 inputs control signals to the above-described first heater drive circuit 410 of the fixing device 400 to control operations of the first heater drive circuit 410. This enables control of heat generation of the first heater 421.

Further, the control section 300 inputs control signals to the auxiliary power source control portion 513 of the auxiliary power source device 500 to control operations of the auxiliary power source control portion 513. This enables control of operations of the power charging portion 511 and the power discharging portion 512 to control charging of power the capacitor device 510 and discharging of power from the capacitor device 510 to the second heater 422. The control section 300 controls discharging of electric power to the second heater 422 to control heat generation of the second heater 422.

The control section 300 obtains sheet jam detection signals indicating occurrence of a sheet jam from the jam detecting sensor 800 and door close detection signals indicating closing of the front cover from the door close detecting sensor 801.

The control section 300 stops operations of respective parts of the copying machine 1 for the printing processing, such as a sheet conveying operation of the conveying path 230 and a toner image forming operation of the image forming section 240 for forming a toner image to a recording sheet, when the jam detecting sensor 800 inputs sheet jam detection signals to the control section 300.

Further, the control section 300 can detect a charged capacity of the capacitor device 510 according signals inputted by the charged capacity detecting portion 514.

FIG. 2 shows function blocks showing details of functions of the control section 300. In FIG. 2, each function block is illustrated in broken lines.

The control section 300 realizes functions of a charge control portion 310, a heat generation control section 320, and a printing processing control portion 330.

The charge control portion 310 is an example of a "charge controller" referred to in the claims.

The heat generation control section 320 allows the fixing device 400 to start up. When a power supply of copying machine 1 is turned on, or the copying machine 1 is restored from a sleep mode to a normal operation mode by the control section 300, the heat generation control section 320 allows both of the first and second heaters 421, 422 or only the first heater 421 to drive to heat cooled fixing roller and the like of the fixing device 400. This allows the heat generation control section 320 to raise the temperature of the fixing roller and the like to a predetermined temperature which is suitable for the fixing processing (for example, 180 degrees Celsius: hereinafter referred to as a fixing executable temperature) to start up the fixing device 400.

It should be understood that the fixing device 400 is provided with a temperature sensor, and the heat generation control section 320 executes a processing of heating the fixing rollers and the like to raise the temperature to the fixing executable temperature in accordance with a detection result of the temperature sensor.

The heat generation control section 320 includes a first heat generation control portion 321 and a second heat generation control portion 322. The heat generation control section 320 can be realized with the functions of these function blocks. The heat generation control section 320 is an example of a "heating roller" referred to in the claims.

The first heat generation control portion 321 allows both the first and second heaters 421, 422 to generate heat to quickly heat the fixing roller and the like.

Further, the second heat generation control portion 322 allows only the first heater 421 to generate heat to relatively slowly heat the fixing roller and the like.

The heat generation control section 320, in ordinary cases other than the cases particularly described herebelow, allows the first heat generation control portion 321 to execute control of rapid heating in the fixing device 400.

Here, also in a case where a sheet jam occurs during printing, operation of the copying machine 1 is stopped as described above, and the heaters 421,422 do not generate heat. Accordingly, the temperature of the fixing roller and the like of the fixing device 400 lowers.

The heat generation control section 320 executes a start-up processing to reheat the fixing roller and the like to raise the temperature to the fixing executable temperature also in a case where a sheet jam occurs during printing and thereafter the sheet jam is treated and the printing processing is restarted. In this case, the heat generation control section 320 executes the start-up processing when the door close detecting sensor 801 inputs a door close detection signal to the control section 300.

The printing processing control portion 330 controls a printing processing performed by the copying machine 1, and drives the sheet-feeding section 220, the conveying path 230, the image forming section 240, and the fixing device 400 (FIG. 1) to allow recording of an image to a recording sheet P stacked on the sheet-feeding section 220 and discharging of the recording sheet P to the sheet discharging section 250.

When this printing processing is performed, the printing processing control portion 330 drives the first heater 421 to maintain the temperature of the fixing roller at a proper temperature in accordance with the drop in temperature of the fixing roller and the like occurred due to passing of the recording sheet P through the fixing device 400.

Then, the printing processing control portion 330 allows the power discharging portion 512 to discharge electric power of the capacitor device 510 to the second heater 422 to drive the second heater 422 for an initial predetermined period especially after when a user presses a printing start button to start the printing processing.

The printing processing control portion 330 allows the second heater 422 to drive for an initial predetermined period also after when the printing processing is restarted after treatment of the sheet jam.

The printing processing control portion 330 is also an example of the "heating controller" referred to in the claims. However, also both of the printing processing control portion 330 and the heat generation control section 320 as a whole may be an example of the "heat controller" referred to in the claims.

As described above, the second heater 422 is driven by the printing processing control portion 330 and the first heat generation control portion 321 in the processing performed after the sheet jam is treated.

The charge control portion 310 controls charging of the capacitor device 510 performed by the power charging portion 511.

The charge control portion 310 allows the power charging portion 511 to charge the capacitor device 510 when a sheet jam occurs and the jam detecting sensor 800 inputs a jam detection signal to the control section 300. In other words, when a sheet jam occurs, and the control section 300 stops all operation of the copying machine 1, the charge control portion 310, on the other hand, allows charging of the capacitor device 510 to be started.

The charge control portion 310 obtains a detection result of the charged capacity detecting portion 514 to determine whether or not the capacitor device 510 is in full-charge and how much charged capacity remains in the capacitor device 510, and performs a charge control.

The charge control portion 310, once it allows charging to the capacitor device 510 in a case other than that described herebelow, allows the charging of power until the charged capacity detecting portion 514 detects a full-charge of the capacitor device 510. Then, the charge control portion 310 allows the charging to be terminated when the full-charge is detected.

Figure 3:
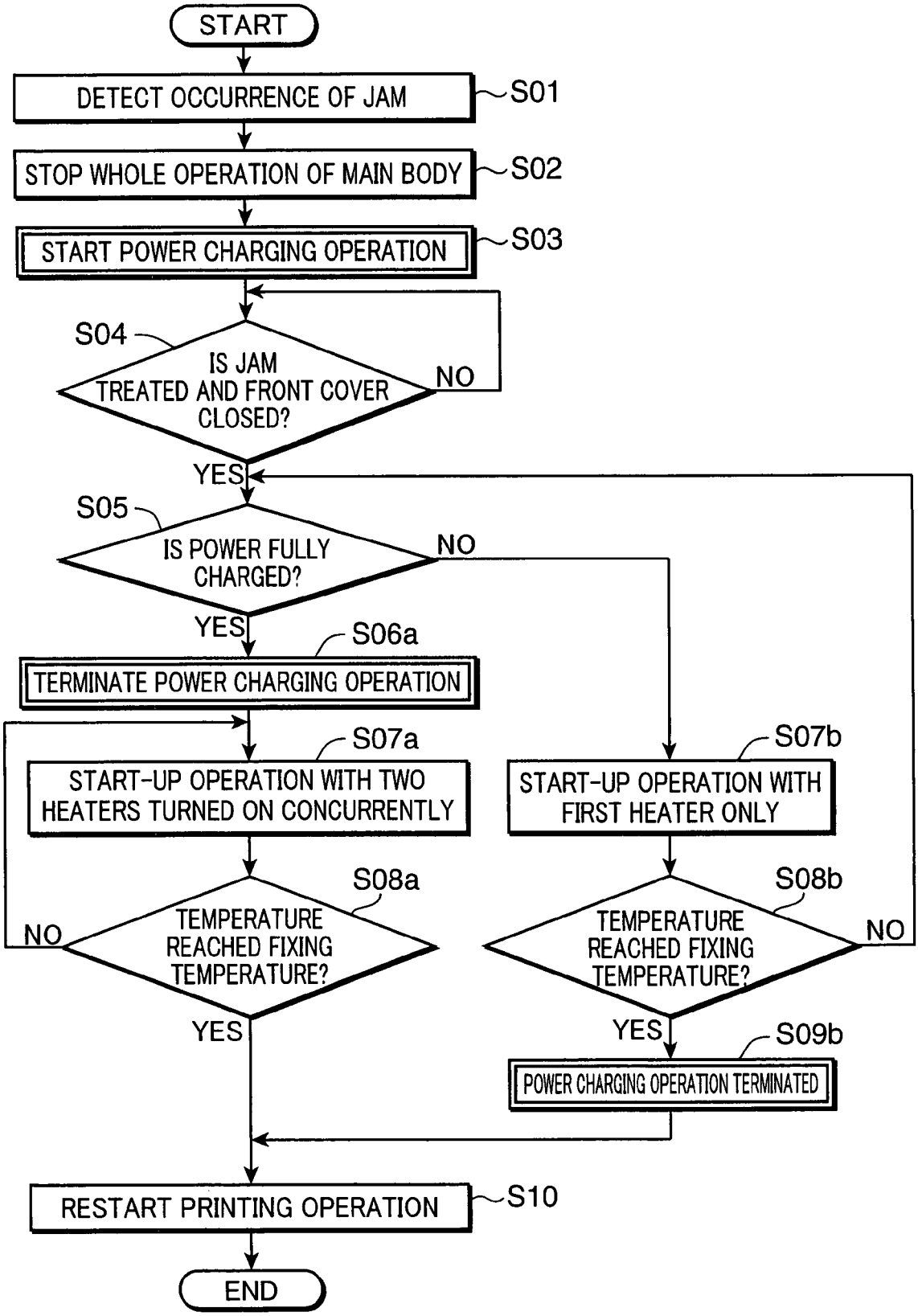
FIG. 3 is a flowchart showing an operation of the copying machine.

FIG. 3 is a flowchart showing an operation of the copying machine 1. The processing of FIG. 3 is an operation which the copying machine starts when a sheet jam occurs during a printing processing. In step S01, the jam detecting sensor 800 detects a sheet jam and outputs a sheet jam detection signal to the control section 300.

In step S02, the control section 300 stops all operation of the copying machine 1 according to the jam detection signal (step S01). At this time, the control section 300 does not allow driving of the first and second heaters 421, 422 of the fixing device 400. This gradually lowers the temperature of the fixing roller and the like to a temperature which is lower than the fixing executable temperature in the fixing device after when the control section 300 performs the processing of step S02.

In step S03, according to an input of the jam detection signal to the control section 300 in step S01, the charge control portion 310 (FIG. 2) allows charging to the capacitor device 510 to be started.

In step S04, the heat generation control section 320 monitors input of a door close detection signal from the door close detecting sensor 801 to the control section 300 (step S04: NO). When the door close detection signal is inputted to the control section 300, the heat generation control section 320 allows to start processings of step S05 and later (step S04: YES).

In step S05, the heat generation control section 320 detects whether or not the capacitor device 510 is already fully charged by the charge control portion 310 (refer to step S03) when the door close detecting sensor 801 inputs a door close detection signal to the control section 300 (step S04:YES). The heat generation control section 320 uses the charged capacity detecting portion 514 through the charge control portion 310 to perform this detection.

In step S06*a*, the charge control portion 310 allows charging to be stopped when the charged capacity detecting portion 514 detects that the capacitor device 510 is already fully charged (step S05:YES). However, the charge control portion 310 allows the power charging portion 511 to stop charging the capacitor device 510 when the charged capacity detecting portion 514 detects a full-charge of the capacitor device 510, even before the door close detecting sensor 801 inputs a door close detection signal to the control section 300 in step S04. The charge control portion 310 does not allow charging to be started in step S03 when it is detected that the capacitor device 510 is fully charged at the time of execution of the processing of step S03.

In steps S07*a* to S08*a*, the heat generation control section 320 uses the first heat generation control portion 321 to allow heating of the second heater 422 by the capacitor device 510, so that the fixing device 400 starts up. The heat generation control section 320 allows the first heat generation control portion 321 to drive the two heaters 421, 422 concurrently (step S07*a*) to heat the fixing roller and the like until the temperature of the fixing roller and the like raises to the above-described fixing executable temperature (step S08*a*: NO).

In step S10, the printing processing control portion 330 allows restarting of the printing processing interrupted by the sheet jam detected by the jam detecting sensor 800 in step S01 after the heat generation control section 320 allows the fixing device 400 to start up in such a manner as described above (step S08:YES). As described above, also in this printing processing, the printing processing control portion 330 allows the second heater 422 to drive with use of electric power supplied by the auxiliary power source device 500.

Figure 4:
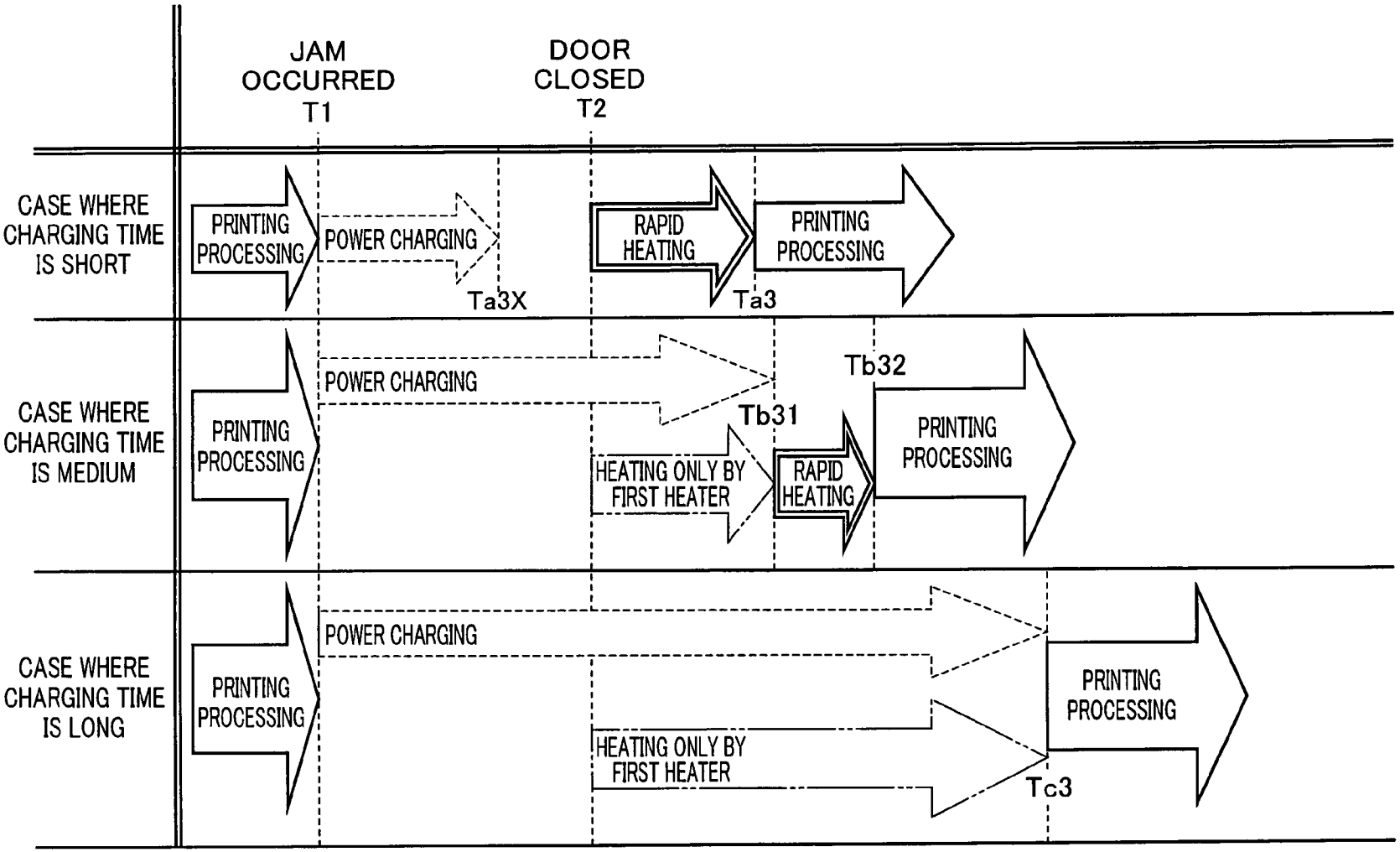
FIG. 4 shows three patterns of operation which the copying machine performs after treatment of a sheet jam.

FIG. 4 shows three patterns of operation which the copying machine 1 performs after treatment of a sheet jam. In FIG. 4, a time axis extends rightward from a timing T1 of occurrence of a sheet jam according to a passage of time, and three patterns of operation performed by the copying machine 1 at respective timings are shown in an upper line, a middle line and a lower line.

In each of the upper line, middle line, and lower line of FIG. 4, the timing T1 is a timing at which the jam detector sensor 800 inputs a sheet jam detection signal to the control section 300 due to occurrence of a sheet jam. A timing T2 is a timing at which a door detection signal indicating closing of the front cover is transmitted to the control section 300 thereafter. At the timing T1 in any case of the upper line, middle line, and lower line of FIG. 4, the control section 300 stops all operation of the copying machine 1 (step S02), and the charge control portion 310 allows charging of the capacitor device 510 to be started (step S03).

The copying machine 1 performs the operation in the upper line of FIG. 4 in such a manner as described above, when the capacitor device 510 is already fully charged (step S05:YES) before a door close detection signal is inputted to the control section 300 (refer to timing T2, step S04).

When the capacitor device 510 is fully charged by the charging performed by the power charging portion 511 to the capacitor device 510, and the full-charge is detected by the charge control portion 310, and then the charge control portion 310 stops the charging (timing Ta3*x*) before the timing T2, and a door close detection signal is inputted to the control section 300 (timing T2, step S04:YES), then the heat generation control section 320 allows the first heat generation control portion 321 to quickly heat the fixing roller and the like (step S07*a*). Accordingly, a starting up of the fixing device 400 is completed expeditiously at a timing Ta3 which is at, for example, ten seconds later from the timing T2 (step S08*a*: YES), and the printing processing control portion 330 restarts the printing processing (step S10, timing Ta3).

The operation shown in the upper line of FIG. 4 is, for example, an operation which is performed in copying machine 1 in a case where the capacitor device 510 has relatively much electric power and the capacity of electric power to be additionally charged is small when a jam occurs at the timing T1. In other words, the operation of the upper line of FIG. 4 is performed when the time necessary for charging (timing T1 to Ta3*x*) is shorter relative to the time between the timings T1 and T2 for treatment of a sheet jam.

On the other hand, when a user closes the front cover, and the door close detecting sensor 801 inputs a door close detection signal to the control section 300 (timing T2, step S04: YES), and the heat generation control section 320 detects that the capacitor device 510 is not fully charged (step S05:NO), the copying machine 1 repeatedly executes the processing of S07*b*, S08*b*, step S05 in a loop, and then performs the processings of step S06*a* and later when the capacitor device 510 is fully charged (step S05:YES).

The operation of the copying machine 1 at this time is shown in the middle line of FIG. 4. At this time, as shown in the drawing, the capacitor device 510 is fully charged at the timing Tb31 which is later than the timing T2 at which a door close detection signal is inputted to the control section 300. Then, the full-charge is detected by the charged capacity detecting portion 514, and thereafter the charging is terminated (step S05:YES). Then, from the timing Tb31, the heat generation control section 320 allows the first heat generation control portion 321 to drive the two heaters 421,422 to quickly heat the fixing roller and start up the fixing device 400 (step S07*a*, S08*a*, timings Tb31 to Tb32).

However, even while the copying machine 1 executes the processing of step S07*b*, S08*b*, and S05 in loop (timings T2 to Tb31), the heat generation control section 320 allows the second heat generation control portion 322 to make the first heater 421 generate heat with use of electric power of the AC input (step S07*b*). Accordingly, this processing shortens a period of time between the timings Tb31 and Tb32. In other words, in step S07*b*, the heat generation control section 320 allows the second heat generation control portion 322 to make only the first heater 421 to generate heat.

In step S08*b*, the heat generation control section 320 similarly confirms that the temperature of the fixing roller and the like does not reach the fixing executable temperature, and makes the routine go back to step S05 in loop unless the temperature reaches the fixing executable temperature (step S08*b*:NO).

The second heat generation control portion 322 allows the first heater 421 to generate heat with electric power which is equal to or less than a remaining electric power after subtracting electric power used by the charge control portion 310 for charging the capacitor device 510 from rated electric power of the AC input (step S07*b*, timing T2 to Tb31). Likewise in the case of the timings T2 to Tc3 of the lower line of FIG. 4 which will be described hereinafter, the second heat generation control portion 322 allows the first heater 421 to generate heat with use of the above-described electric power.

The operation in the middle line of FIG. 4 is an operation which is performed when a necessary charging time (timings T1 to Tb31) is longer relative to the time length between the timings T1 and T2 than the case of the upper line of FIG. 4.

Finally, a processing will be described which is performed when the heat generation control section 320 detects termination of the start up of the fixing device 400 after only the first heater 421 keeps generating heat (loop processing of step S07*b*, S08*b*, S05) to raise the temperature of the fixing roller and the like to the fixing executable temperature.

In step S09*b*, in this case (step S08*b*:YES), the heat generation control section 320 gives an instruction to the charge control portion 310 to stop charging the capacitor device 510 at the point of time (step S09*b*, timing Tc3 in the lower line of FIG. 4). Then, the printing processing control portion 330 thereafter uses the fixing device 400, which has been already started up, to start the printing processing (step S10, after the timing Tc3 in the lower line of FIG. 4).

In the case of the lower line of FIG. 4, the charging started at the timing T1 is not terminated even at the timing Tc3 at which the start-up of the fixing device with heating only by the first heater 421 is completed, but is forcibly stopped by the charge control portion 310 at this timing Tc3 and terminated.

In this case, the electric power of the capacitor device 510 which the charge control portion 310 allowed charging from the timing T1 (step S03) is not used for the starting up of the fixing device 400, but is used by the printing processing control portion 300 only for the printing processing in step S10.

The operation in the lower line of FIG. 4 is an operation of the copying machine 1 which is performed when the necessary charging time is very long relative to the time length between the timings T1 and T2.

According to such configuration of the copying machine 1, when the jam detecting sensor 800 detects a sheet jam (timing T1, step S04:YES), the capacitor device 510 is charged (the timing T1 and later, and the step S03 and later). Accordingly, the capacitor device 510 can be charged by utilizing the time for operation of treating the sheet jam by a user, so that the second heater 422 can generate heat assuredly without any delay with use of electric power of the capacitor device 510 when an image forming is restarted after the treatment of the sheet jam.

Firstly, rapid start up of the fixing device 400 can be performed assuredly without delay by allowing both the first heater 421 and the second heater 422 generate heat (step S07*a*, timings T2 to Ta3 in the case of the upper line of FIG. 4, timings Tb31 to Tb32 in the case of the middle line of FIG. 4). Further, in the printing processing (step S10, timing Ta3 and later, timing Tb32 and later, timing Tc3 and later), generation of heat by the second heater 422 can be performed assuredly without any delay. This assuredly prevents, for example, improper fixing processing performed due to unevenness of the surface temperature in the respective parts of the roller and the like and taking up of time for a long aging operation prior to the printing processing, without delay.

Further, according to this configuration, during the charge control portion 310 allows charging of the capacitor device 510 to be continued, the first heater 421 generates heat with a constant electric power in advance (timings T2 to Tb31 in the case of the middle line of FIG. 4, timings T2 to Tc3 in the case of the lower line of FIG. 4). Accordingly, the fixing device 400 can start up in an early stage.

Furthermore, according to this configuration, after the starting up of the fixing device 400 is completed, the charging of the auxiliary power source device 500 is stopped (timing Tc3 of the case of the lower line of FIG. 4, step S08*b*:YES, step S09*b*), and thereby the printing is started quickly.

Furthermore, according to this configuration, when the door close detecting sensor 801 detects closing of the front cover, and the charged capacity detecting portion 514 detects that the capacitor device 510 is fully charged, both the two heaters 421, 422 are allowed to start generating heat to quickly start up the fixing device 400 (step S07*a*, timings T2 to Ta3, timings Tb31 to Tb32). Accordingly, the image forming after the treatment of the sheet jam can be quickly restarted.

Furthermore, according to this configuration, the capacitor device 510 is fully charged by continuing the charging after the sheet jam is treated (timings T2 to Tb31 in the case of the middle line of FIG. 4, timings T2 to Tc3 in the case of the lower line of FIG. 4, step S05: NO, steps S07*b*, S08*b*:NO), and both the first and second heaters 421, 422 generate heat to quickly starting up the fixing device 400.

Hereinafter other embodiments will be described.

(A) The printing processing control portion 330 may allow only the first heater 421 to generate heat in the printing processing (step S10, timing Ta3 and later in the upper line of FIG. 4, timing Tc32 and later in the middle line of FIG. 4, timing Tc3 or later in the lower line of FIG. 4). In other words, it may be so configured that only the first heat generation control portion 321 allows the second heater 422 to generate heat, but the printing processing control portion 330 does not allow the second heater 422 to generate heat (refer to step S07*a*, timings T2 to Ta3 in the upper line of FIG. 4, timings Tb31 to Tb32 in the middle line of FIG. 4).

(B) In step S09*b*, the charge control portion 310 may allow the charging of the capacitor device 510 until the charged capacity detecting portion 514 detects a full-charge of the capacitor device 510, and thereafter it may allow the charging to be stopped. This enables the printing processing control portion 330 to drive the second heater 422 to perform the printing processing in step S10 in a state where the capacitor device 510 is fully charged.

(C) The heat generation control section 320 may allow the routine to not to go through the processing of steps S07*b*, S08*b*, S09*b* but may wait until the charging is completed in step S05. When the capacitor device 510 is not fully charged (step S05:NO), the routine may go back to the processing of step S04 again.

(D) When a user closes the front cover, and the door close detecting sensor 801 detects the same (step S04:YES), the routine may skip step S05 to allow the copying machine 1 to perform the processing of step S06*a*. In other words, the copying machine 1 may omit the processing of steps S07*b*, S08*b*, S09*b*, S05.

In this case, when the door close detecting sensor 801 inputs a door close detection signal to the control section 300 (step S04:YES), the charge control portion 310 allows the charging to be stopped immediately (step S06*a*). Even if the capacitor device 510 is not fully charged (refer to the descriptions above regarding step S05), the heat generation control section 320 allows the heaters 421, 422 to start up the fixing device 400 (steps S07*a*, S08*a*). In this case, the heat generation control section 320 may allow the fixing device 400 to be started up without the two heaters 421, 422 but with only the first heater 421 driven by the AC input.

(E) Also in step S07*a*, like the case of step S07*b*, the heat generation control section 320 may allow the second heat generation control portion 322 to start up the fixing device 400 (step S07*a*, timings T2 to Ta3 in the upper line of FIG. 4, timings Tb31 to Tb32 in the middle line of FIG. 4). In other words, the heat generation of the second heater 422 may be controlled by the printing processing control portion 330 but not by the first heat generation control portion 321 (step S10, timing Ta3 or later in the upper line of FIG. 4, timing Tb32 or later in the middle line of FIG. 4, timing Tc3 or later in the lower line of FIG. 4).

(F) At least a part of functions of the charged capacity detecting portion 514 may be realized, for example, by the control section 300. For instance, the control section 300 may calculate the charged capacity of the capacitor device 510 in accordance with a control signal which the control section 300 allows the auxiliary power source control portion 513 to input.

In summary, the present invention includes an image forming apparatus which comprises: an auxiliary power source device for storing electric power of a commercial power source and supplying the stored electric power; a fixing device including: a first heat generator for generating heat for a fixing processing, the first heat generator using electric power supplied by the commercial power source; and a second heat generator for generating heat for the fixing processing, the second heat generator using electric power supplied by the auxiliary power source device; a heat generation controller for allowing the first heat generator and the second heat generator to generate heat; an image forming section for forming an image on a recording sheet, the image forming section including the fixing device and a sheet conveyance path to allow the recording sheet to pass through the fixing device along the sheet conveyance path; a sheet jam detector for detecting a sheet jam of a recording sheet which occurs in the image forming section; a charged capacity detector for detecting a charged capacity of the auxiliary power source device; and a charge controller for allowing charging of the auxiliary power source device to start when the sheet jam detector detects a sheet jam, and the charged capacity detector detects no full charge of the auxiliary power source device.

According to this invention, when the sheet jam detector detects occurrence of the sheet jam, and the charged capacity detector detects that the auxiliary power source device is not fully charged, charging of the auxiliary power source device is started. Accordingly, the auxiliary power source device can be charged while utilizing a time for treating the sheet jam by a user, and a processing of generating heat performed by the second heat generator with use of electric power of the auxiliary power source device after the treatment of the sheet jam can be performed assuredly without any delay.

Further, the present invention further comprises a cover operation detector for detecting a closing of an openable cover provided on a housing of the apparatus for allowing a user to treat a sheet jam. The charge controller allows the auxiliary power source device to continue charging, and the heat generation controller allows only the first heat generator to generate heat to start up the fixing device when the cover operation detector detects the closing of the cover after the sheet jam detector detects no sheet jam, and the charge capacity detector detects no full charge of the auxiliary power source device.

According to this invention, the starting up of the fixing device can be started with generation of heat by the first heat generator while the auxiliary power source device is charged, so that the fixing device is started up quickly.

Further, according to the present invention, the heat generation controller allows the first heat generator to generate heat with electric power which is equal to or less than a remaining electric power after subtracting electric power used by the charge controller for charging from rated electric power of the commercial power source when the cover operation detector detects the closing of the cover after the sheet jam detector detects no sheet jam, and the charge controller allows the auxiliary power source device to continue charging.

According to this invention, the first heat generator can generate heat while the charging to the auxiliary power source device is performed.

Further, the present invention further comprises a temperature detector for detecting a temperature of the fixing device. The charge controller allows the auxiliary power source device to stop charging when the temperature detector detects reaching of the temperature of the fixing device to a predetermined fixing temperature while the charge controller allows charging of the auxiliary power source device, and the heat generation controller allows only the first heat generator to generate heat after the sheet jam detector detects no sheet jam, and the cover operation detector detects closing of the cover.

According to this invention, the charging of the auxiliary power source device is stopped when the temperature of the fixing device reaches the fixing executable temperature and the starting up of the fixing device is completed, so that an image forming can be started immediately without causing a delay due to the charging operation.

Further, the present invention further comprises a temperature detector for detecting a temperature of the fixing device. The charge controllers allows the auxiliary power source device to continue charging until the charge capacity detector detects a full-charge of the auxiliary power source device even when the temperature detector detects reaching of the temperature of the fixing device to a predetermined fixing temperature while the charge controller allows charging of the auxiliary power source device, and the heat generation controller allows only the first heat generator to generate heat after the sheet jam detector detects no sheet jam, and the cover operation detector detects closing of the cover.

According to this invention, even when the temperature of the fixing device reaches the fixing executable temperature and the starting up of the fixing device is completed, charging of the auxiliary power source device is continued until it is fully charged. Accordingly, the electric power of the auxiliary power source device in the full-charge state can be used for an image forming operation to be performed thereafter.

Further, the present invention further comprises a cover operation detector for detecting closing of an openable cover provided on a housing of the apparatus for allowing a user to treat a sheet jam. The heat generation controller allows the first heat generator and the second heat generator to generate heat to quickly start up the fixing device when the sheet jam detector detects no sheet jam, and the cover operation detector detects closing of the cover, and the charge capacity detector detects a full-charge of the auxiliary power source device.

According to this invention, at the time when it becomes possible to quickly start up the fixing device by using both the first heat generator and the second heat generator, starting up of the fixing device can be performed with both the heat generator immediately. Accordingly, a time necessary for completing the start up of the fixing device can be shortened.

Further, the image forming apparatus according to the present invention further comprises a cover operation detector for detecting closing of an openable cover provided on a housing of the apparatus for allowing a user to treat a sheet jam. The charge controller allows the auxiliary power source device to stop charging, and the heat generation controller allows the first heat generator and the second heat generator to generate heat to quickly start up the fixing device after the sheet jam detector detects no sheet jam, and the cover operation detector detects closing of the cover.

According to this invention, the heating controller allows both the first heat generator and the second heat generator to generate heat to start up the fixing device without waiting for the auxiliary power source device to be fully charged. Accordingly, when the fixing device can be started up earlier with use of existing electric power of the auxiliary power source device than waiting for the auxiliary power source device to be fully charged, for example, when the temperature of the fixing device is close to the fixing executable temperature, it is effective for shortening the time for starting up the fixing device.

Further, the present invention further comprises a temperature detector for detecting a temperature of the fixing device. The heat generation controller allows the second heat generator to generate heat when the sheet jam detector detects no sheet jam, and the temperature detector detects reaching of the temperature of the fixing device to a predetermined fixing temperature, and the fixing device is used for image forming performed by the image forming section.

According to this invention, the second heat generator generates heat in a printing processing performed after treatment of a sheet jam. Accordingly, instead of performing an aging processing necessary for making the surface temperature of the fixing roller provided in the fixing device to be uniform in each part, the heat generated by the second heat generator is applied to the surface of the fixing roller so that the surface temperature of the fixing roller be uniform in each part. Accordingly, the aging processing can be omitted. This prevents occurrence of improper fixing processing at end portions of the fixing roller and the like.

This application is based on Japanese Patent application serial No. 2006-290792 filed in Japan Patent Office on Oct. 26, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an auxiliary power source device for storing electric power of a commercial power source and supplying the stored electric power;

a fixing device including:

a first heat generator for generating heat for a fixing processing, the first heat generator using electric power supplied by the commercial power source; and a second heat generator for generating heat for the fixing processing, the second heat generator using electric power supplied by the auxiliary power source device;

a heat generation controller for allowing the first heat generator and the second heat generator to generate heat;

an image forming section for forming an image on a recording sheet, the image forming section including the fixing device and a sheet conveyance path to allow the recording sheet to pass through the fixing device along the sheet conveyance path;

a sheet jam detector for detecting a sheet jam of a recording sheet which occurs in the image forming section;

a charged capacity detector for detecting a charged capacity of the auxiliary power source device;

a charge controller for allowing charging of the auxiliary power source device to start when the sheet jam detector detects a sheet jam, and the charged capacity detector detects no full charge of the auxiliary power source device; and a cover operation detector for detecting a closing of an openable cover provided on a housing of the apparatus for allowing a user to treat a sheet jam, wherein the charge controller allows the auxiliary power source device to continue charging, and the heat generation controller allows only the first heat generator to generate heat to start up the fixing device when the cover operation detector detects the closing of the cover after the sheet jam detector detects no sheet jam, and the charge capacity detector detects no full charge of the auxiliary power source device, and the heat generation controller allows the first heat generator to generate heat with electric power which is equal to or less than a remaining electric power after subtracting electric power used by the charge controller for charging from rated electric power of the commercial power source when the cover operation detector detects the closing of the cover after the sheet jam detector detects no sheet jam, and the charge controller allows the auxiliary power source device to continue charging.

2. The image forming apparatus according to claim 1, further comprising a temperature detector for detecting a temperature of the fixing device, wherein the charge controller allows the auxiliary power source device to stop charging when the temperature detector detects reaching of the temperature of the fixing device to a predetermined fixing temperature while the charge controller allows charging of the auxiliary power source device, and the heat generation controller allows only the first heat generator to generate heat after the sheet jam detector detects no sheet jam, and the cover operation detector detects closing of the cover.

3. The image forming apparatus according to claim 1 is, further comprising a temperature detector for detecting a temperature of the fixing device, wherein the charge controller allows the auxiliary power source device to continue charging until the charge capacity detector detects a full-charge of the auxiliary power source device even when the temperature detector detects reaching of the temperature of the fixing device to a predetermined fixing temperature while the charge controller allows charging of the auxiliary power source device, and the heat generation controller allows only the first heat generator to generate heat after the sheet jam detector detects no sheet jam, and the cover operation detector detects closing of the cover.

4. The image forming apparatus according to claim 1, further comprising a temperature detector for detecting a temperature of the fixing device, wherein the heat generation controller allows the second heat generator to generate heat when the sheet jam detector detects no sheet jam, and the temperature detector detects reaching of the temperature of the fixing device to a predetermined fixing temperature, and the fixing device is used for image forming performed by the image forming section.

5. The image forming apparatus according to claim 1, wherein the heat generation controller allows the first heat generator and the second heat generator to generate heat to quickly start up the fixing device when the charge capacity detector detects a full-charge of the auxiliary power source device.

* * * * *